US011363687B2

(12) United States Patent
Hayman et al.

(10) Patent No.: US 11,363,687 B2
(45) Date of Patent: Jun. 14, 2022

(54) LOW VOLTAGE SWITCHING DEVICE

(71) Applicant: J2 Light Inc., St. Albert (CA)

(72) Inventors: Jeff Hayman, St. Albert (CA); Jeremy MacGillivray, St. Albert (CA)

( * ) Notice: Subject to any disclaimer, the term of this patent is extended or adjusted under 35 U.S.C. 154(b) by 0 days.

(21) Appl. No.: 17/230,508

(22) Filed: Apr. 14, 2021

(65) Prior Publication Data

US 2021/0321499 A1 Oct. 14, 2021

(51) Int. Cl.
*H05B 45/10* (2020.01)
*H05B 45/48* (2020.01)

(52) U.S. Cl.
CPC ..... *H05B 45/10* (2020.01); *H05B 45/48* (2020.01)

(58) Field of Classification Search
CPC ..... H05B 45/10; H05B 45/48
See application file for complete search history.

(56) References Cited

U.S. PATENT DOCUMENTS

2004/0207341 A1* 10/2004 Callahan ..... H05B 45/46 315/291
2014/0049186 A1* 2/2014 Fortini ..... H05B 45/10 315/250
2017/0188419 A1* 6/2017 Gaertner ..... H05B 45/14

* cited by examiner

*Primary Examiner* — Minh D A
(74) *Attorney, Agent, or Firm* — Andrews Robichaud PC

(57) ABSTRACT

The present disclosure provides a portable low voltage switching device to control the power and brightness of LEDs in LE arrays. The device is further comprised of two circuits, one power circuit to control the LED wattage, and another brightness circuit to control the LED lumens. The device is connected in between an LED driver and the LED arrays, receiving a stepped down DC voltage and splitting it across the two LED arrays. The device can provide power and adjust the brightness to both of the LED arrays, with the first LED array having a "warm" colour and the second LED array having a "cool" colour. Therefore, instead of using a single light fixture containing a single LED array, the device can be used with a single fixture having two LED arrays, providing a variety of brightness and power options to the cool and warm colours.

8 Claims, 3 Drawing Sheets

LOW VOLTAGE SWITCHING DEVICE

CROSS REFERENCE TO RELATED APPLICATION

The present application claims priority to Canadian Patent Application No. CA 3,078,046, entitled "Low Voltage Switching Device" filed on Apr. 14, 2020, the contents of which are incorporated herein by reference in their entirety.

FIELD

The disclosure relates to the field of electronic switches, and more specifically to low voltage switches for flexible lighting controls.

BACKGROUND

In the last few decades, as a result of climate change and global warming, the world has been shifting to more environmentally friendly appliances. Lighting fixtures with conventional incandescent, fluorescent, or high intensity discharge sources are being rapidly replaced by Light Emitting Diode (LED) technology. LEDs deliver significantly more lumens per watt and last much longer. LEDs are available in a variety of colours, from "warmer" colours in the 2700-3500 Kelvin range, to "cooler" colours typically in the 4000-6500K range.

A major challenge for manufacturers and re-sellers of LED lights and fixtures is that there are a wide variety of discrete color and wattage combinations that serve the market. Consider that a typical 2'×4' recessed grid ceiling (T-Bar) fixture commonly used in schools and offices, may have 10+ common iterations of static color and wattage combinations (ie. 3000K, 3500K and 4000K in 20 W, 25 W, and 30 W). Since it is impossible to predict demand ahead of supply, manufacturers and re-sellers must expend much more on inventory to be able to address market need quickly as most sales will not afford lengthy procurement and production lead times.

This problem is far reaching across all platforms and applications for indoor lighting products. The most common drivers in the industry (power conditioning device that resides between building power and LEDs) allow for a controllable power output by supplying 0-10V DC through an auxiliary circuit. This was designed for users that wish to add lighting control equipment such as dimmers for their applications. This option is rarely exercised, yet this driver version dominates supply and is therefore readily available, cost effective, and has a long history of usage.

Other options exist in the art, whereby power and CCT switching is offered; however, they are built directly into the driver. This limits the options for users as they are forced to purchase a discrete driver design that is limited in availability as well as in wattage output and voltage input options. The discrete drivers are offered by fewer sources and have less history in the market whereas the devices described in the present disclosure may be used in conjunction with all common 0-10V drivers. This offers broad availability from existing trusted lighting sources. Further, should a discrete driver fail and the source of the driver no longer produces the discrete model or is no longer in business, the ability to replace becomes much more difficult and expensive, whereas common 0-10V drivers are available from many sources.

Therefore, there is a need for a device that eliminates the need to carry all of the LED fixture variants that can be easily added to the most common drivers used in the lighting industry.

SUMMARY

In an aspect, the present disclosure provides a portable low voltage switching device to electrically adjust a plurality of light emitting diodes (LEDs), the device comprising: a power control circuit to control power of the plurality of LEDs; a brightness control circuit to control brightness of the plurality of the LEDs; wherein the power control circuit and brightness control circuit are electrically connected to an external LED driver module, the external LED driver module receiving power from a source; and wherein the power control circuit and brightness control circuit are electrically connected to at least two LED array modules.

In another aspect, the present disclosure provides a portable low voltage switching device to electrically adjust a plurality of light emitting diodes (LEDs), the device comprising: a power control circuit to control power of the plurality of LEDs, the power control circuit electrically connected to an external LED driver module, the external LED driver module receiving power from a source; wherein the power control circuit is electrically connected to at least two LED array modules.

BRIEF DESCRIPTION OF THE DRAWINGS

The following figures serve to illustrate various embodiments of features of the disclosure. These figures are illustrative and are not intended to be limiting.

DETAILED DESCRIPTION

The following embodiments are merely illustrative and are not intended to be limiting. It will be appreciated that various modifications and/or alterations to the embodiments described herein may be made without departing from the disclosure and any modifications and/or alterations are within the scope of the contemplated disclosure.

Figure 1:
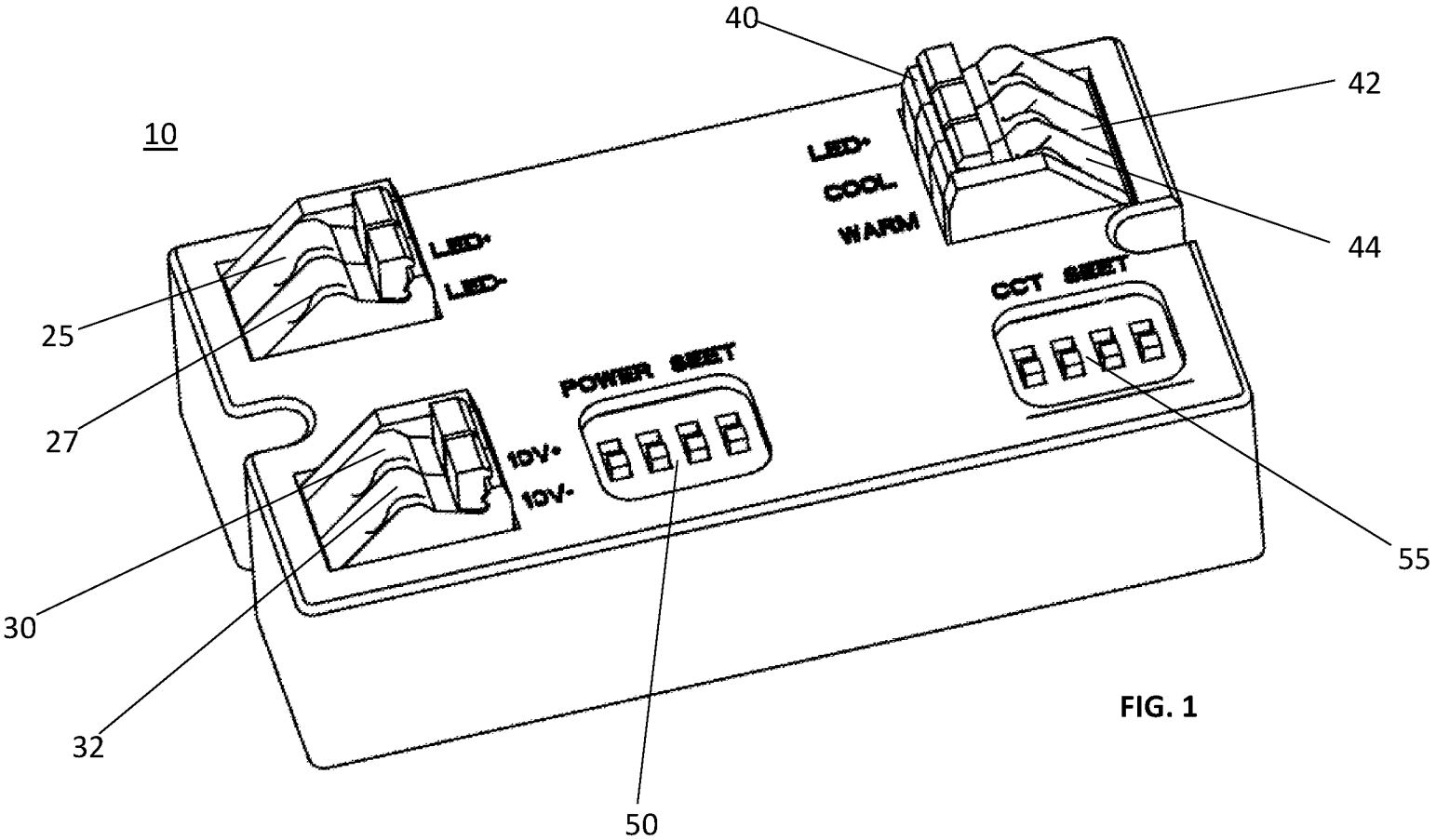
FIG. 1 is a perspective view of a low voltage switching device, according to an embodiment of the present disclosure.
Figure 2:
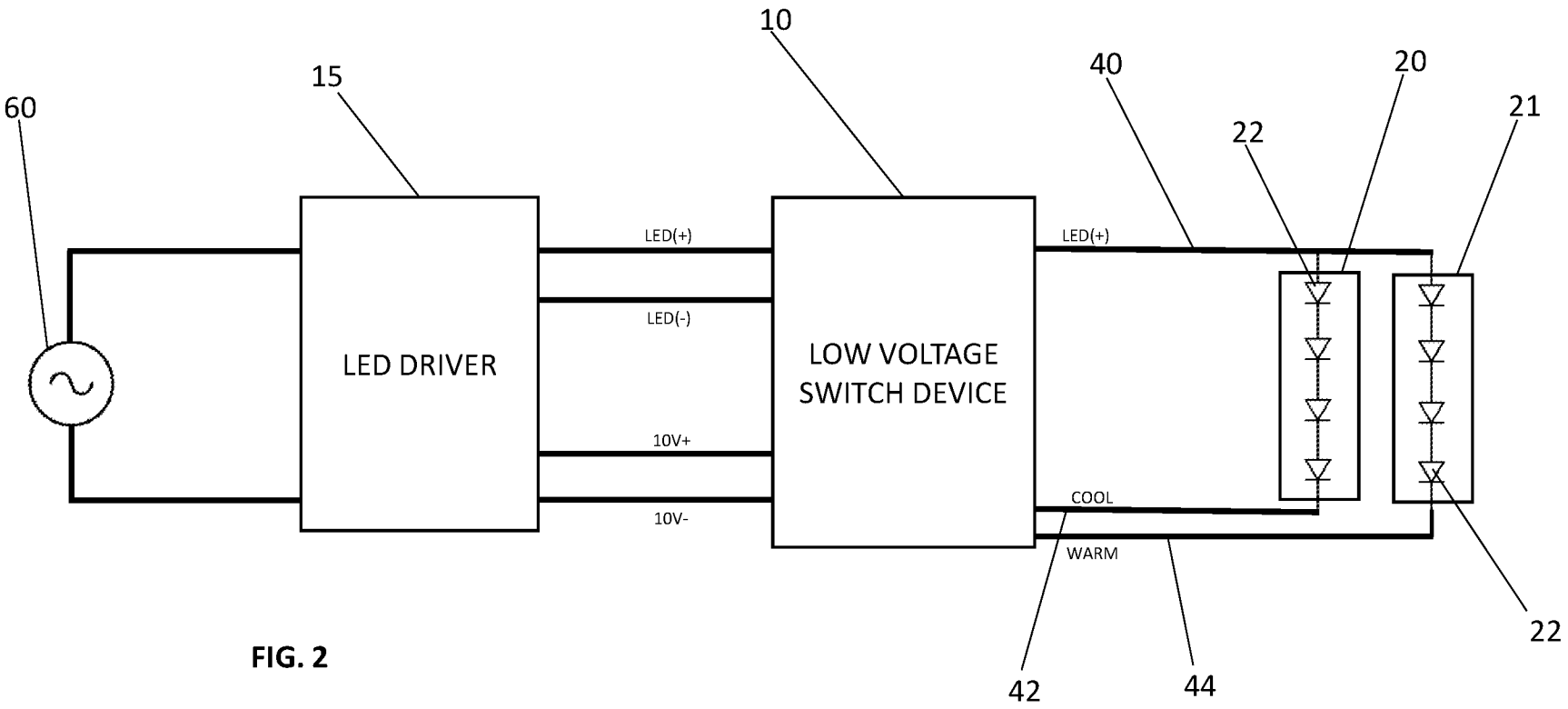
FIG. 2 is a block circuit diagram of the low voltage switching device connected to a LED driver and a LED array module, according to an embodiment of the present disclosure; and, FIG. 3 is a perspective view of a low voltage power switching device for LED arrays, according to another embodiment of the present disclosure.

With reference to FIGS. 1 and 2 and according to an embodiment of the present disclosure, a low voltage switching device 10 is shown. A worker skilled in the art would appreciate that the device 10 is preferably used with commercial light emitting diode (LED) arrays and that low voltage is typically less than 60V. Indeed, the device 10 is adapted to be electrically connected in between an external LED array driver 15 and various LED array modules 20, 21, the LED array modules 20, 21 being further comprised of a plurality of LEDs 22. The device 10 is comprised of first and second pins 25, 27, which accept low voltage direct current from the driver 15 to the LED array modules 20, 21. The device 10 is also comprised of third and fourth pins 30, 32, which determine the total current output (also known as dimming voltage) from the driver 15 to the LED array modules 20, 21. This is accomplished by switch 50, which provides variable settings thereby controlling 0-10 VDC of the driver 15. Indeed, by changing the voltage within a range of 0-10 VDC, an operator of the device 10 changes the power to the LED modules 20, 21. The device 10 is comprised of internal circuitry (not shown), which serves to convert the inputs and outputs from pins 25, 27, 30, 32, into first, second and third outputs from pins 40, 42, 44, respectively. More specifically, the first output pin 40 denoted as LED(+) is shared by the two LED modules 20, 21. In other words, the device 10 takes the low voltage direct current from the driver 15 and splits it into two, one for each LED module 20, 21. The second output pin 42 is a singular electrical connection to the first LED module 20, while the third output pin 44 is a singular electrical connection to the second LED module 21. The second and third output pins 42, 44 have separate current controls. The total current remains constant as set by switch 50; however, the ratio of current to each LED array 20, 21 is adjustable by switch 55. The switch 55 provides variable settings, thereby allowing adjustment of overall color of the LEDs 22. A worker skilled in the art would appreciate that first output pin 40 corresponds to the split (i.e. shared) DC return for the LEDs 20, while the second and third output pins 42, 44 correspond to separate DC voltage going to the correlated colour temperature (CCT) modules of the LEDs 20. The word "COOL" is used to denote shorter wavelength LEDs, where the output colour of the LEDs 22 is closer to ultraviolet on the visible light spectrum. The word "WARM" is used to denote longer wavelength LEDs, where the output colour of the LEDs 22 is closer to infrared on the visible light spectrum. The first, second and third output pins 40, 42, 44 of the device 10 are configured to receive a wire to be electrically connected to the LED array module 20. To change the brightness of the LEDs 22, an operator can manipulate a power switch 50 that is positioned on the device 10. To change the colour of the LEDs, from a warmer colour to a cooler colour as described above, an operator can manipulate a CCT switch 55 that is positioned on the device 10. As such, instead of stocking or purchasing a plurality of discrete light colour and output fixtures containing a single LED array, a user can purchase a single fixture with two arrays that offer the same plurality simply by adjusting the power and CCT switches 50, 55. In this particular embodiment, the power and CCT switches 50, 55 are dual in-line package (DIP) switches, although other switch types are possible.

With specific reference to FIG. 2 and according to an embodiment of the present disclosure, the device 10 is shown electrically connected in between the LED driver 15 and the first and second LED array modules 20, 21. The first LED array module 20 corresponds to "COOL" lighting, while the second LED array module 21 corresponds to "WARM" lighting. An AC power source 60 is shown, the power source 60 typically providing 120/277V power to the LED driver 15, in turn the LED driver 15 converting the AC into DC power. A worker skilled in the art would appreciate that other power sources 60 are possible that can provide 347V or 480V as known in the art. The incoming AC power as received from the power source 60 is further split into DC outputs labelled LED(+), LED(−), 10V(+) and 10V(−). The LED driver 15 is comprised of a first circuit to feed LED(+) to the device 10, and a second separate circuit to feed 10V(+) to the device 10. As outlined above, the power switch (not shown) affects the first circuit, which in turn affects the power (wattage) of the LEDs 22. The CCT switch (not shown) affects the second separate circuit, which in turn affects the brightness (lumen) of the LEDs 22. Advantageously, an operator can manipulate the power and CCT switches (not shown) to create the desired combination of power and brightness on the two LED array modules 20, 21. Indeed, the device 10 can be utilized with any existing and preferred LED arrays to create a variety of desired combinations. The device 10 provides further flexibility as it can be added at different sale stages, from manufacturing, distribution or installation.

With further reference to FIG. 2 and according to an embodiment of the present disclosure, the switching device 10 is comprised of a power control circuit (not shown) to control power of the plurality of LEDs 22 in each of the LED arrays 20, 21 and a brightness control circuit (not shown) to control brightness of the plurality of the LEDs 22 in each of the LED arrays 20, 21. The power control brightness control circuits (not shown) are electrically connected to the LED driver module 15 and are also electrically connected to the two LED array modules 20, 21. The switching device 10 separately provides adjustable power to each of the LED array modules 20, 21 to offer a single output that is the sum of the two LED arrays 20, 21. A worker skilled in the art would appreciate that the power and CCT switches 50, 55 shown in FIG. 1 form part of and are in electrical engagement with the power control circuit (not shown) and brightness control circuit (not shown), respectively.

Figure 3:
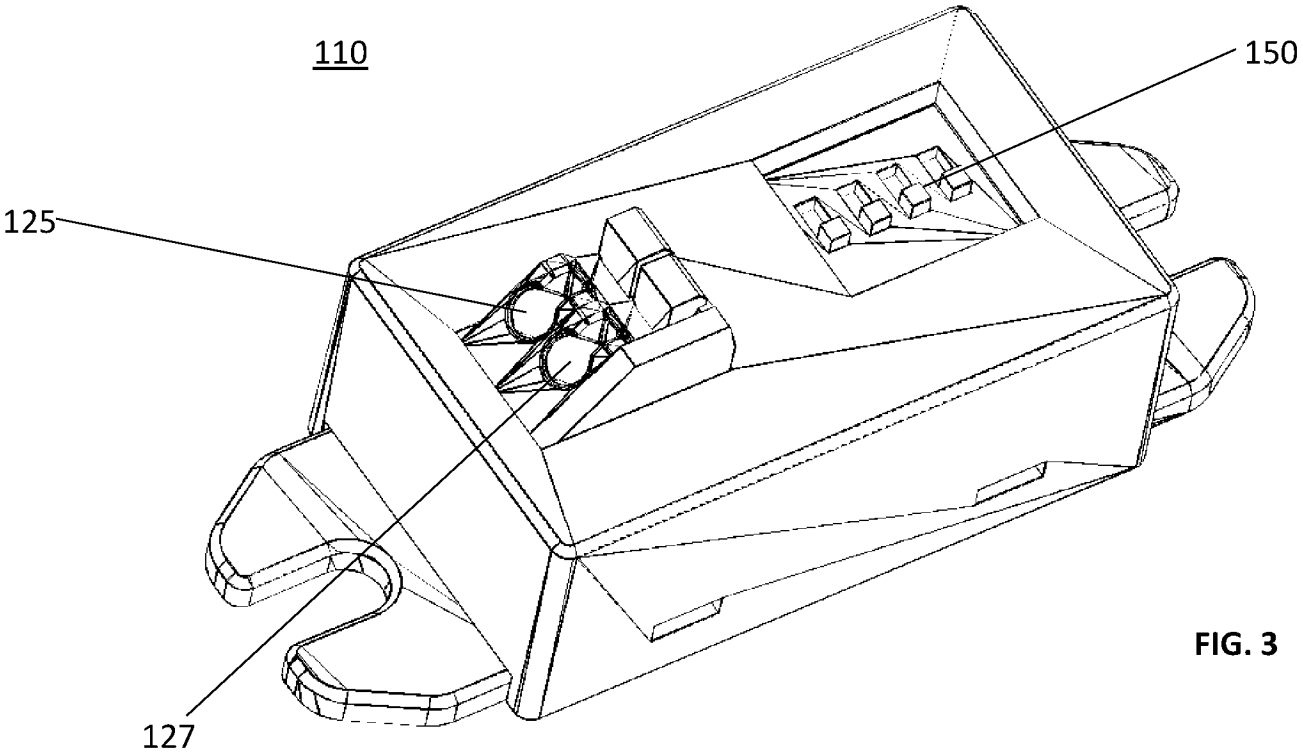

With reference to FIG. 3 and according to an embodiment of the present disclosure, a low voltage power switching device 110 for LED arrays is shown. The device 110 is comprised of first and second pins 125, 127, which accept low voltage direct current from the driver (not shown) to the LED array modules (not shown). The device 110 is also comprised of a power switch 150 to manipulate the power of the LEDs (not shown). In this particular embodiment, the power switch 150 is a dual in-line package (DIP) switch, although other switch types are possible.

The portable low voltage switching device 110 to electrically adjust a plurality of LED arrays, the switching device 110 comprising a power control circuit (not shown) to control power of the plurality of LED arrays, the power control circuit (not shown) electrically connected to an external LED driver module (not shown), the external LED driver module (not shown) receiving power from a source (not shown). The power control circuit (not shown) is electrically connected to at least two LED array modules (not shown), and the power control circuit is also connected to the power switch 150.

Many modifications of the embodiments described herein as well as other embodiments may be evident to a person skilled in the art having the benefit of the teachings presented in the foregoing description and associated drawings. It is understood that these modifications and additional embodiments are captured within the scope of the contemplated disclosure, which is not to be limited to the specific embodiment(s) disclosed.

The invention claimed is:

1. A portable low voltage switching device to electrically adjust a plurality of light emitting diodes (LEDs), the device comprising:

- a power control circuit to control power of the plurality of LEDs;
- a brightness control circuit to control brightness of the plurality of the LEDs;
- a first output pin connected to:
  - at least one first LED array module having a first wavelength; and,
  - at least one second LED array module having a second wavelength;

a second output pin connected to the at least one first LED array module; and, a third output pin connected to the at least one second LED array module;

wherein the first wavelength is variable independently from the second wavelength;

wherein the power control circuit and brightness control circuit are electrically connected to an LED driver module, the LED driver module receiving power from a source;

and wherein the power control circuit and brightness control circuit are electrically connected to the at least one first LED array module and to the at least one second LED array module.

2. The portable low voltage switching device of claim 1 wherein the power control circuit is further comprised of a power switch to adjust the power of the plurality of LEDs within a first range.

3. The portable low voltage switching device of claim 2 whereby the power switch is a dual in-line package (DIP) switch.

4. The portable low voltage switching device of claim 1 wherein the brightness control circuit is further comprised of a brightness switch to adjust the brightness of the plurality of LEDs within a second range.

5. The portable low voltage switching device of claim 4 whereby the brightness switch is a dual in-line package (DIP) switch.

6. The portable low voltage switching device of claim 1 separately providing adjustable power to the at least one first LED array module and to the at least one second LED array module to offer a single output that is the sum of the at least one first LED array module and the at least one second LED array module.

7. The portable low voltage switching device of claim 1 further comprised of two pins to accept low voltage direct current from the LED driver module to the at least one first LED array module and to the at least one second LED array module.

8. The portable low voltage switching device of claim 1 further comprised of two pins to determine dimming voltage from the LED driver module to the at least one first LED array module and to the at least one second LED array module.

* * * * *